US007874189B2

(12) United States Patent
Martin

(10) Patent No.: US 7,874,189 B2
(45) Date of Patent: Jan. 25, 2011

(54) FIELD-REVERSIBLE CABINET LATCH LOCK

(75) Inventor: Frank J. Martin, Edmonds, WA (US)

(73) Assignee: Frank J. Martin Company, Lynnwood, WA (US)

( * ) Notice: Subject to any disclaimer, the term of this patent is extended or adjusted under 35 U.S.C. 154(b) by 538 days.

(21) Appl. No.: 11/811,261

(22) Filed: Jun. 7, 2007

(65) Prior Publication Data

US 2008/0302144 A1 Dec. 11, 2008

(51) Int. Cl.
*E05B 65/44* (2006.01)

(52) U.S. Cl. ..... 70/85; 70/81; 70/107; 70/370; 70/371; 70/451

(58) Field of Classification Search ..... 70/78, 70/81, 82, 85, 86, 99, 100, 107, 110, 134, 70/141, 144, 150, 151 R, 371, 379 R, 380, 70/370, 374, 451, 461, 462, 466; 292/147
See application file for complete search history.

(56) References Cited

U.S. PATENT DOCUMENTS 2,275,362 A * 3/1942 Golden et al. ..... 70/134
3,141,319 A * 7/1964 Schlage ..... 70/81
3,589,152 A * 6/1971 Glass et al. ..... 70/81
3,824,817 A * 7/1974 Orr ..... 70/81
3,919,866 A * 11/1975 Lipschutz ..... 70/81
4,012,928 A * 3/1977 Dauenbaugh ..... 70/81
4,672,827 A * 6/1987 Craig ..... 70/367
4,899,563 A 2/1990 Martin
5,038,589 A 8/1991 Martin
5,121,619 A * 6/1992 Martin ..... 70/371
5,551,263 A * 9/1996 Myers et al. ..... 70/86
5,657,652 A 8/1997 Martin
5,678,438 A * 10/1997 Kolkman et al. ..... 70/370
5,737,950 A 4/1998 Yun-Bin
6,920,770 B2 * 7/2005 Lurie et al. ..... 70/371

* cited by examiner

*Primary Examiner*—Lloyd A Gall
*Assistant Examiner*—Christopher Boswell
(74) *Attorney, Agent, or Firm*—Black Lowe & Graham PLLC

(57) ABSTRACT

A four-way, field-reversible self-latching cabinet lock includes a cylinder and plug assembly shell that is rotatable with respect to a bolt housing cover for the lock. A locking device is provided to fix the cylinder and plug assembly shell in one of four orthogonal positions with respect to the bolt housing cover. The bolt housing cover is receivable by a bolt housing and conventional self-latching latch bolt. In this manner, pins in the cylinder and plug assembly may be retained in a desirable vertical position while a throw of the bolt can be adjusted to vertical, inverted, left-hand, and right-hand positions in the field without special tools or additional parts.

10 Claims, 3 Drawing Sheets

FIELD-REVERSIBLE CABINET LATCH LOCK

TECHNICAL FIELD

The invention relates to pin tumbler cabinet door and drawer locks. More specifically, the invention relates to self-latching locks for cabinet doors and drawers.

BACKGROUND OF THE INVENTION

There are two basic families of cabinet drawer and door locks: deadlocking and latch locking types of locks, and cam-type locks. Both families of locks are used on cabinet drawers and doors such as those found on office desks, credenzas, and interior cabinetry. In the former family, an elongated bolt moves in a reciprocating manner into and out of a bolt housing between locked and unlocked positions, respectively, upon actuation of a key. In the latter family, an elongated bolt moves along an arcuate path, between locked and unlocked positions. In the cam family of locks, an angular rotation of 90 degrees is typically sufficient to determine the locked and unlocked positions.

Both families of locks may have their bolts actuated by either pin tumbler cylinder and plug assemblies, or disk tumbler-type assemblies. The disk tumbler-type assemblies are the least expensive and historically have been used in the cam type of lock. A lock of this type is shown in U.S. Pat. No. 3,863,476 to Patriquin, in which a plurality of spring-loaded plates in a plug are biased to position a protrusion from the plates into an elongated trough or cavity in an externally threaded lock body. Interference between the protrusions and sidewalls of the lock body trough prevent rotation of the plug. Upon insertion of a key into a keyway of the plug, the plates retract and the protrusions are withdrawn from the trough. Thereupon, the plug can rotate within the threaded lock body. The plug is longitudinally restrained within the lock body by a spring-loaded clip. The bolt is typically journaled for rotation with and screwed onto a longitudinal extension at the rear of the plug.

Over the years, it has become desirable to provide cam locks with a pin tumbler rather than a disk tumbler system. In the pin tumbler system, the disk plates are replaced with a series of cylindrical pins, which reside in bores in the plug. These "bottom pins" have differing lengths corresponding to protrusions and valleys in a mating key. The lock body or cylinder is provided with a corresponding series of spring-loaded top pins that can drop down into the bores in the plug into which the lower pins reside. When a key is inserted into the plug keyway, the top pins and bottom pins form a shear line at the interface of the plug and cylinder, allowing the plug to rotate freely. A particular problem with this type of lock is that the key can be inserted or removed only when the top and bottom pins are in alignment (typically the 12 o'clock position).

In contrast to cam type locks, deadlocking and latch locking types of locks have a bolt that reciprocates transversely with respect to a keyway of the lock. In the deadlocking type of lock, the bolt remains in an extended or retracted position and is not translatable therefrom without operation of the key. In a latch locking type of lock, the bolt has a curvature on the end thereof and is spring-biased to the extended position. Transverse pressure on the curved portion of the bolt urges the bolt against the spring bias to a retracted position so that a cabinet door or drawer can be closed without the use of a key. The latch locking type of cabinet lock can also be provided with a separate deadlocking bolt that prevents "jimmying" of the spring-biased latch bolt when the deadlocking portion of the latch bolt is depressed, such as by a strike plate. An example of a rekeyable pin tumbler type of deadlocking cabinet lock is shown in U.S. Pat. No. 4,899,563, assigned to the Frank J. Martin Company, Seattle, Wash.; an example of a deadlocking, self-latching cabinet door and drawer deadlocking latch lock is shown in U.S. Pat. No. 5,657,652, assigned to the same assignee.

In all of the above types of locks, either a disk tumbler type of assembly or a pin tumbler type of assembly may be used. It is known to those of ordinary skill in this art, particularly with respect to the pin tumbler type of locks, that it is desirable to maintain the orientation of the bottom pins, top pins, and springs in a vertical orientation to prevent the lock from jamming, which may occur if the pins are not maintained in a vertical position (e.g., the pins are lying on their side in a horizontal plane). For this reason, cabinet door and drawer locks are typically sold in left-hand, right-hand, vertical-hand, and inverted-hand versions in which the bolt is presented in four orthogonal directions while the keyway is always maintained in the vertical position. The assignee of the present invention and/or its predecessors in interest have sold a variety of locks in these configurations, such as the Olympus Lock Company's Models 997 and 996 door and drawer latch locks. Clearly, the maintenance of stock on hand of four different varieties of every type of lock is costly, and a clear need exists for a single type of latch lock that is field configurable to any one of the above four orthogonal positions. However, complex assemblies and parts that are difficult or expensive to manufacture are generally undesirable in the lock art. Simple assemblies generally permit reduced manufacturing costs, improved reliability, and serviceability in the field. In addition, locks that require special tools to facilitate disassembly for rekeying purposes or the like have been historically disfavored by locksmiths. As a result, the development of a commercially viable, field-reversible four-way latch lock has eluded the industry. Thus, a need exists for a low-cost, pin tumbler self-latching cabinet door and drawer lock that is field reversible by locksmiths to any one of four orthogonal positions.

SUMMARY OF THE INVENTION

It is therefore an object of the present invention to provide a low-cost, pin tumbler self-latching cabinet door and drawer lock that is field reversible by locksmiths to any one of four orthogonal positions.

The invention achieves the above objects, and other objects and advantages that will become apparent from the description, which follows, by providing a four-way, field-reversible, self-latching cabinet lock. The lock includes a bolt housing cover defining a central aperture. The lock is provided with a cylinder and plug assembly shell having a rear wall defining a circular plug aperture registrable with the central aperture in the bolt housing cover. The shell is further provided with a rearwardly directed hub that extends axially through and away from the shell so that the shell is journaled for rotation with respect to the bolt housing cover. The shell is axially restrained in the bolt housing cover by a locking mechanism such as a spring clip or split ring so that shell can be rotated with respect to the bolt housing cover in one of a plurality of operating positions. The operating positions may be orthogonal with respect to one another to correspond to a vertical bolt position, an inverted bolt position, a left-hand bolt position, and a right-hand bolt position. A pin-type cylinder and plug assembly is preferably removably received in the shell. The bolt housing cover is removably received on a bolt housing, which houses a reciprocating, spring-biased latch bolt. A rotary cam is also received in the bolt housing and has a rear side adapted for operational connection with the bolt so as to retract the bolt into the bolt housing when the rotary cam is rotated. The front side of the rotary cam is adapted for receipt of a cam driver that couples the rotary cam to the plug of the cylinder and plug assembly. In this way, the shell can be repositioned (with the cylinder and plug assembly therein) to any one of the operational positions so as to maintain orientation of the pins in the cylinder and plug assembly in the desired vertical position regardless of whether the bolt is in a vertical, inverted, left, or right extending position.

In preferred embodiments of the invention, the lock is preferably provided with a locking mechanism for selectively rotationally retaining and releasing the shell with respect to the bolt housing cover in one of the operating positions. As stated above, the operating positions may be orthogonal. In preferred embodiments of the invention, the cylinder and plug assembly is preferably slidably and removably received in the shell, and the shell includes a selectively releasable securing mechanisms (e.g., a set screw) for axially securing the cylinder and plug assembly in the shell. The rearwardly directed hub of the cylinder and plug assembly shell may be provided with four orthogonal bores for receipt of the set screw, and the bolt housing cover may be provided with a radially directed, threaded bore that penetrates the central aperture in the bolt housing cover. Thus, the set screw may interact with the holes or detents in the hub to releasably secure the cylinder and plug assembly shell in any one of the operating positions.

DETAILED DESCRIPTION OF THE PREFERRED EMBODIMENTS

Figure 1:
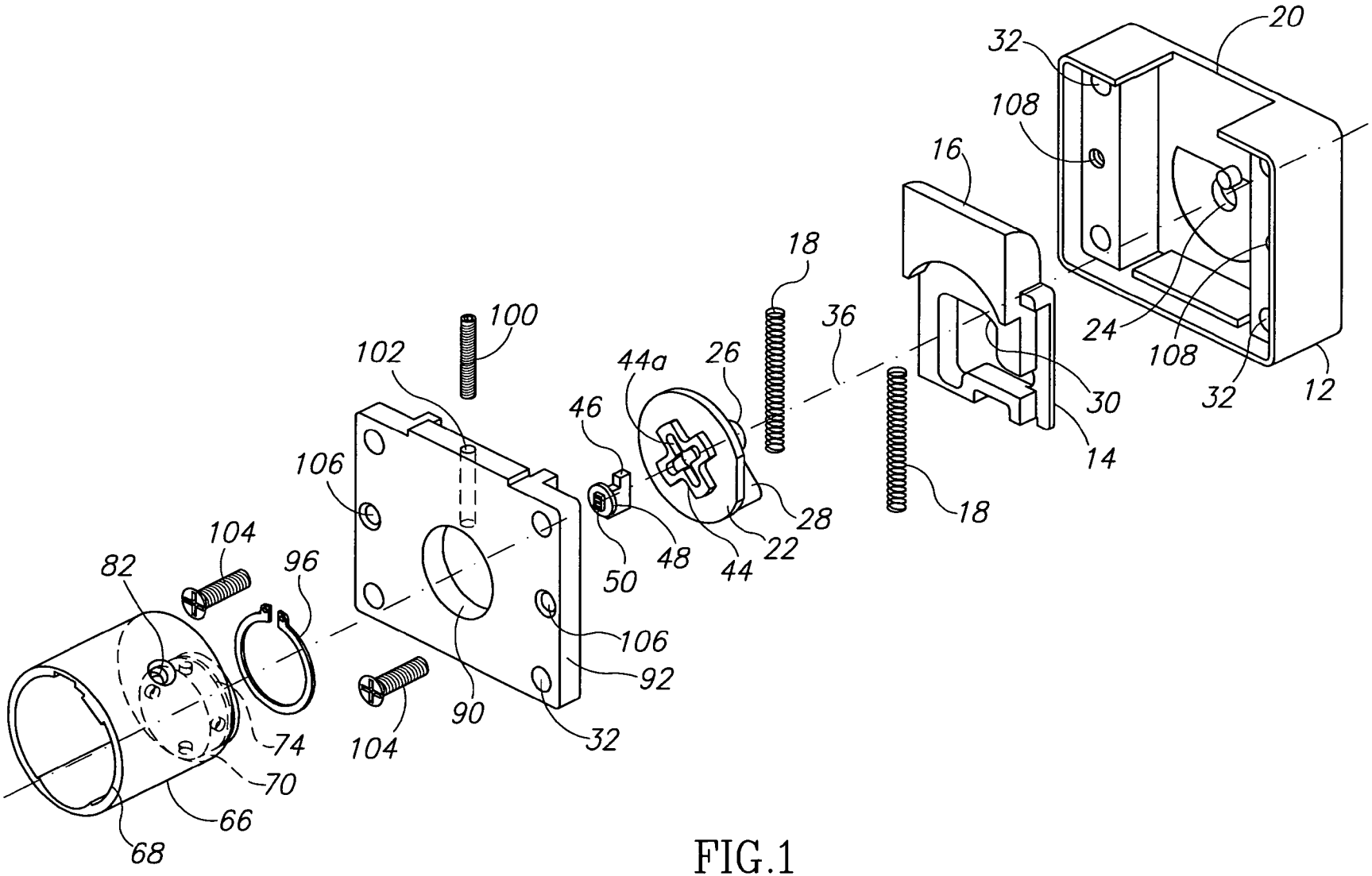
FIG. 1 is an exploded isometric view of a preferred embodiment of the invention.
Figure 2:
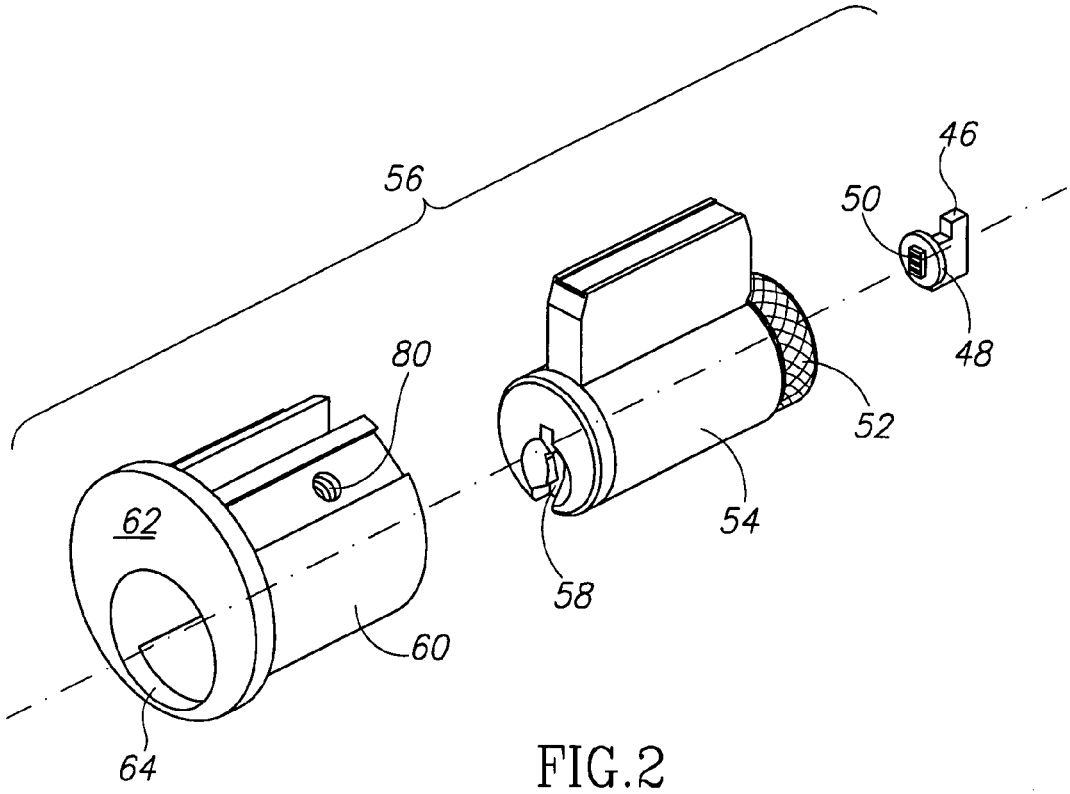
FIG. 2 is an exploded isometric view of a cylinder and plug assembly, and cam driver that is receivable in the invention shown in FIG. 1.
Figure 3:
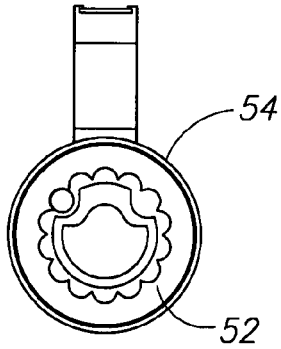
FIG. 3 is a rear elevational view of a plug shown in FIG. 2.
Figure 4:
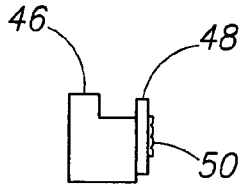
FIG. 4 is a side elevational view of the cam driver shown in FIG. 2.

A field-reversible cabinet lock in accordance with the principles of the invention is generally indicated at reference numeral 10 in the various Figures of the attached drawings, wherein numbered elements in the Figures correspond to like numbered elements herein. As best seen in FIG. 1, the lock 10 includes a conventional bolt housing 12 that receives a conventional, self-latching bolt 14 having an upper curved section 16 for operation against a conventional strike or strike plate (not shown). The bolt 14 is biased, such as by springs 18 in the conventional manner to reciprocate through a recess 20 in the bolt housing 12 between extended and retracted positions. A rotary cam 22 is journaled for rotation in a bolt housing aperture 24 by way of an axially extending arbor 26 in the conventional manner. The cam has a radially directed arm 28 on the reverse side thereof that interacts with a bolt cutout surface 30 in the conventional manner such that, when the cam 22 is rotationally driven, the arm 28 urges the bolt 14 through interaction of the arm 28 and cutout surface 30 to retract the bolt 14 against the spring pressure. In this manner, the lock 10, when connected to a cabinet drawer, for example, by way of mounting holes 32, allows the drawer to be opened. Conversely, the drawer can be closed by merely sliding the drawer toward the closed position whereby the curved section 16 will interact with the strike plate (not shown) urging the bolt to compress the springs 18 such that the bolt is in the retracted position and may pass the strike, allowing the drawer to close and the bolt to reextend. The cam 22 rotates about a main axis 36 shown in phantom line. A front face (or front side) 40 of the cam 22 has transverse grooves or rebates 44 for receipt of a dogleg-shaped first portion 46 of a cam driver 48, best seen in FIGS. 1, 2, and 4. The first portion 46 is positioned on a rear side of the cam driver so as to be received in any one of four lobes 44*a* of the rebates 44, depending on the orthogonal, desired position of the bolt 16 (e.g., vertical, inverted, left-hand, right-hand). The cam driver 48 has a second portion 50 for interaction with a rear end 52 of a plug 54 of an axially removable cylinder and plug assembly 56. The plug 54 is a conventional type commonly referred to as an "insert cylinder" type, such as manufactured by Schlage for use with conventional deadbolt locks, such as those used on entryways. This type of pin tumbler plug conventionally is used with an extended tailpiece, such as that shown in U.S. Pat. No. 5,657,652 to Martin, assigned to the assignee of the present invention and issued on Aug. 19, 1997, the disclosure of which is incorporated herein by reference. In the present invention, the conventional tailpiece is merely shortened to the inventive cam driver 48 so as to selectively, rotationally couple a keyway 58 in the plug 54 with the rotary cam 22. The cylinder and plug assembly 56 is provided with a cylinder 60 adapted to slidably receive the plug 54 from a rearward, axial direction. A front face 62 of the cylinder 60 is provided with an aperture 64 for access to the keyway 58 when the plug 54 is received in the cylinder 60.

Figure 5:
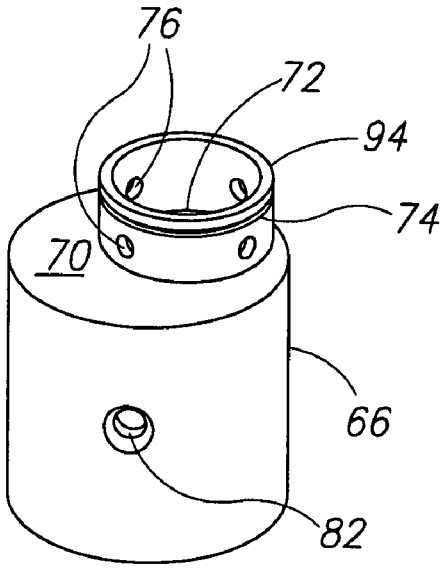
FIG. 5 is an isometric, top left view of the cylinder and plug assembly shell shown in FIG. 1, illustrating an axially and rearwardly directed hub portion thereof.

The entire cylinder and plug assembly 56 is forwardly receivable in a cylinder and plug assembly annular shell 66, as best seen in FIGS. 1 and 5. The shell has a forward aperture 68 for receiving the aforementioned cylinder and plug assembly 56. The shell 66 has a rear wall 70 defining a plug aperture 72 such that the plug rear end 52 may pass therethrough. The rear wall 70 also has a rearward, axially directed hub portion 74 also having a substantially cylindrical shape defining four transverse, orthogonal and radially directed detents or holes 76 for purposes that will be described further hereinbelow. The cylinder and plug assembly 60 is provided with a radially directed threaded bore 80 that is alignable with a shell aperture 82 so that a set screw or the like (not shown) may be used to axially and rotationally retain the cylinder and plug assembly inside the shell 66, as described in detail in U.S. Pat. No. 5,657,652, previously referenced herein, the disclosure of which is incorporated by reference. The hub portion 74 of the cylinder and plug assembly shell 66 is received in a central aperture 90 of a bolt housing cover 92 as best seen with reference to FIG. 1. The hub portion 74 has a length greater than a thickness of the bolt housing cover 92 such that a circumferential groove 94 (see FIG. 5) on a rearward portion of the hub 74 protrudes rearwardly beyond the bolt housing cover. A spring-loaded clip 96, circlip, split ring, or the like is applied to the circumferential groove 94 after the hub 74 has been received in the central aperture 90, to axially restrain the shell 66 with respect to the bolt housing cover 92, while permitting rotational movement of the shell 66 with respect thereto. It should be noted that the rotational axis of the hub 74, plug 54, cam driver 48, and rotary cam 22 are coincident with the main axis 36. However, the axis of the shell 66 is displaced therefrom in a conventional manner. Thus, the bolt housing 12, bolt housing cover 92, and all of the structural elements therebetween are rotatable with respect to the shell 66, while tumbler pins (not shown) residing in the plug 54 can be maintained in a desirable, vertical position, as will be appreciated by those of ordinary skill in the relevant art. In order to maintain orientation of the shell 66, with respect to the bolt housing 12, bolt housing cover 92, and all of the elements therebetween, the hub 74 is provided with the four orthogonal detents or holes 76, which can be engaged by an elongated set screw 100 received in a radially directed threaded bore 102 in the bolt housing cover 92. Thus, a locksmith can reorient the shell 66 with respect to the bolt housing cover 92, bolt housing 12, and parts therebetween into any one of the above-described four orthogonal positions such that the first portion 46 on the rear side of the cam driver 48 may engage an appropriate one of the orthogonal lobes 44*a* in the rebates 44 on the rotary cam 22. To facilitate the structural realignment, bolt housing cover 92 may be released from the bolt housing 12, such as by conventional screws 104, which are received in corresponding holes 106 in the bolt housing cover 92 and cooperatively threaded holes 108 in the bolt housing 12.

Figure 6:
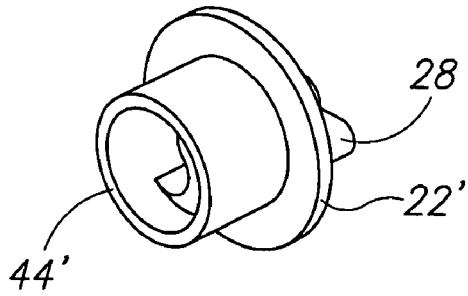
FIG. 6 is a left front perspective view of a rotary cam for use in an alternate embodiment of the invention, illustrating a front side of the rotary cam.
Figure 7:
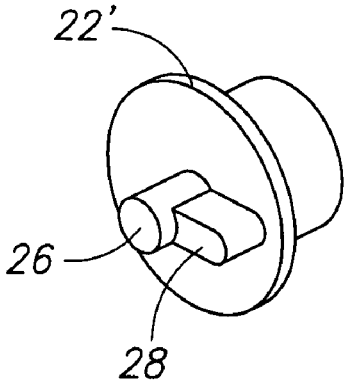
FIG. 7 is a rear perspective view of the rotary cam shown in FIG. 6.
Figure 8:
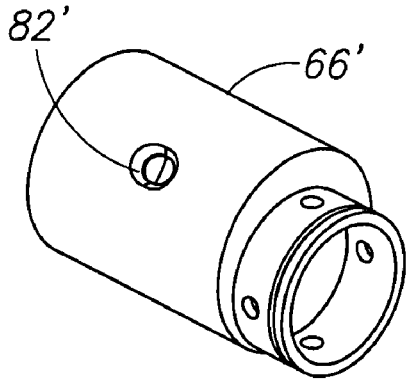
FIG. 8 is a bottom, rear perspective view of a cylinder and plug assembly shell for use with an alternate embodiment of the invention.

In an alternate embodiment of the invention, particularly for use with a small pin-type cylinder and plug assembly, which has a fixed rearward projection on the plug portion thereof (as will be well known to those of ordinary skill in the art), an alternate version of a cam driver 22', as shown in FIG. 6, is provided having a front face 44' adapted to receive the fixed driver of the small pin-type plug. The rear side of the alternate rotary cam 22' is shown in FIG. 7 and is otherwise identical to the first version of the rotary cam 22 shown in FIG. 1. In this alternate embodiment, the cam driver 48 is not needed. The alternate embodiment of the lock 10 is provided with a modified cylinder and plug assembly shell 66', as shown in FIG. 8, in which the shell aperture 82' is modified so as to have a figure-8 shape allowing the entire cylinder and plug assembly (not shown) to be moved forwardly so as to disengage the integral rear protrusion on the plug from the rotary cam 22'. In this manner, the shell 66' may be rotated with respect to the bolt housing cover 92 without removing the bolt housing cover from the bolt housing 12.

Those of ordinary skill in the art will conceive of other alternate embodiments of the invention upon reviewing this disclosure. Thus, the invention is not to be limited to the above description, but is to be determined in scope by the claims that follow.

I claim:

1. A four-way, field-reversible self-latching cabinet lock, comprising:

a substantially planar bolt housing cover defining a substantially central aperture and a radially directed bore penetrating the aperture;

a substantially hollow cylinder and plug assembly shell having a rear wall defining a circular plug aperture registrable with the central aperture and a rearwardly directed hub extending axially away from the plug aperture and sized for rotational receipt in the central aperture so that the shell is journaled for rotation with respect to the bolt housing cover;

locking means for rotationally retaining and releasing the shell with respect to the bolt housing cover in one of four orthogonal operating positions;

a cylinder and plug assembly removably received in the shell;

a bolt housing reciprocally receiving a spring-biased latch bolt, the bolt housing adapted to removably receive the bolt housing cover;

a rotary cam having a rear side operationally connected to the bolt and an obverse front side having a pair of transverse rebates for operational receipt of a first side of a cam driver; and, a cam driver operationally coupled to the cylinder and plug assembly wherein the cam driver has a first portion for selective rotary connection and synchronization with the rebates, whereby the locking means can be operated to permit rotation of the shell to any one of the four orthogonal operating positions so as to maintain orientation of pins in the plug in a desirably vertical position whether the bolt is in an up, down, left, and right extending position.

2. The cabinet lock of claim 1, wherein the cam driver first portion includes an "L" shaped axial projection for engaging the cylinder and plug assembly.

3. The cabinet lock of claim 1, wherein the cylinder and plug assembly is slidably and removably received in the shell, and the shell includes releasable securing means for axially securing the cylinder and plug assembly in the shell.

4. The cabinet lock of claim 1, wherein the hub has a length exceeding a thickness of the bolt housing cover and further defines a circumferential groove for removable receipt of a spring-biased clip for releasably securing the shell with respect to the bolt housing cover.

5. The cabinet lock of claim 1, wherein the cam driver is integral with the plug of the cylinder and plug assembly.

6. The cabinet lock of claim 1, wherein the locking means is an elongated set screw adapted for receipt in the radially directed bore and wherein the hub has four orthogonally spaced detents for receipt of the set screw.

7. A field-reversible self-latching cabinet lock, comprising:

a bolt housing cover defining a central aperture;

a cylinder and plug assembly shell having a rear wall defining a circular plug aperture registrable with the central aperture and a rearwardly directed hub extending axially through and away therefrom so that the shell is journaled for rotation with respect to the bolt housing cover;

locking means for selectively retaining and releasing the shell with respect to the bolt housing cover in one of a plurality of operating positions;

a cylinder and plug assembly removably received in the shell;

a bolt housing reciprocally receiving a spring-biased latch bolt, the bolt housing adapted to receive the bolt housing cover;

a rotary cam having a rear side adapted for operational connection with the bolt and an obverse front side having means for operational receipt of a cam driver; and, a cam driver operationally coupled to the cylinder and plug assembly wherein the cam driver has a first portion for selective rotary connection and synchronization with the cam front side, whereby the locking means can be operated to permit rotation of the shell to any one of the operating positions so as to maintain orientation of pins in the plug in a desirably vertical position whether the bolt is in an up, down, left, and right extending position.

8. The cabinet lock of claim 7 wherein the cam driver is integral with the plug.

9. The cabinet lock of claim 7, wherein the cylinder and plug assembly is slidably received in the shell, and the shell includes securing means for axially securing the cylinder and plug assembly in the shell.

10. The cabinet lock of claim 7, wherein the hub has a length exceeding a thickness of the bolt housing cover and defines a circumferential groove for removable receipt of a spring-biased retaining clip for securing the shell with respect to the bolt housing cover.

* * * * *